US010598463B2

(12) United States Patent
Jeung

(10) Patent No.: US 10,598,463 B2
(45) Date of Patent: Mar. 24, 2020

(54) DOT SIGHTING DEVICE

(71) Applicant: Bo Sun Jeung, Bucheon-si (KR)

(72) Inventor: Bo Sun Jeung, Bucheon-si (KR)

( * ) Notice: Subject to any disclaimer, the term of this patent is extended or adjusted under 35 U.S.C. 154(b) by 16 days.

(21) Appl. No.: 15/954,192

(22) Filed: Apr. 16, 2018

(65) Prior Publication Data

US 2018/0231351 A1 Aug. 16, 2018

Related U.S. Application Data

(60) Continuation of application No. 15/582,683, filed on Apr. 29, 2017, now Pat. No. 9,945,638, which is a division of application No. 15/099,278, filed on Apr. 14, 2016, now Pat. No. 9,671,195.

(30) Foreign Application Priority Data

Apr. 15, 2015 (KR) ..... 10-2015-0052970

(51) Int. Cl.
*F41G 1/34* (2006.01)
*F41G 1/30* (2006.01)

(52) U.S. Cl.
CPC ..... *F41G 1/345* (2013.01); *F41G 1/30* (2013.01)

(58) Field of Classification Search
CPC ..... F41G 1/345; F41G 1/30
USPC ..... 42/113
See application file for complete search history.

(56) References Cited

U.S. PATENT DOCUMENTS

| | | | | |
|---|---|---|---|---|
| 3,867,764 | A | 2/1975 | Dunmire et al. | |
| 4,168,588 | A | 9/1979 | Snyder | |
| 4,417,814 | A | 11/1983 | Doliber | |
| 5,351,429 | A | 10/1994 | Ford | |
| 5,653,034 | A * | 8/1997 | Bindon | F41G 1/345 33/297 |
| 7,472,830 | B2 | 1/2009 | Danielson | |
| 7,634,866 | B2 * | 12/2009 | Javorsky | F41G 1/345 42/111 |
| 8,087,196 | B2 * | 1/2012 | Jung | F41G 1/30 42/113 |
| 8,127,485 | B2 | 3/2012 | Moore et al. | |
| 8,132,353 | B2 | 3/2012 | Lin et al. | |
| 8,151,510 | B2 * | 4/2012 | Capson | F41G 1/01 42/111 |
| 2006/0163359 | A1 | 7/2006 | Danielson | |
| 2008/0216379 | A1 * | 9/2008 | Javorsky | F41G 1/12 42/115 |
| 2010/0077646 | A1 * | 4/2010 | Gaber | F41G 1/30 42/123 |
| 2011/0067288 | A1 * | 3/2011 | Hakansson | F41G 1/38 42/119 |
| 2012/0000979 | A1 | 1/2012 | Horvath et al. | |

(Continued)

*Primary Examiner* — Samir Abdosh
(74) *Attorney, Agent, or Firm* — Baker & McKenzie

(57) ABSTRACT

A sighting device includes a body, a light emitting unit, a bracket, a first adjusting unit and a second adjusting unit. The body couples to an arm having a barrel. The body is disposed relative to the arm in a first direction defined on an up and down axis. A third direction is defined as a direction of the barrel on a front and back axis. A second direction is defined as a left and right axis. The bracket couples to the light emitting unit. The first adjusting unit couples the bracket to the body and moves the bracket relative to the body. The second adjusting unit couples the bracket to the body and moves the bracket relative to the body.

19 Claims, 15 Drawing Sheets

(56) References Cited

U.S. PATENT DOCUMENTS

| | | | | |
|---|---|---|---|---|
| 2012/0151816 | A1* | 6/2012 | Kleck | F41G 1/30 42/132 |
| 2014/0075820 | A1 | 3/2014 | Ben-Ami | |
| 2014/0109456 | A1* | 4/2014 | Jung | F41G 1/30 42/113 |
| 2015/0007481 | A1 | 1/2015 | Houde-Walter | |
| 2015/0198415 | A1* | 7/2015 | Campean | F41G 1/18 42/137 |
| 2016/0161735 | A1* | 6/2016 | Armbruster | G02B 23/14 359/15 |

* cited by examiner

DOT SIGHTING DEVICE

CROSS REFERENCE TO RELATED APPLICATIONS

This application is a continuation application of application Ser. No. 15/582,683 filed on Apr. 29, 2017, which is a divisional application of U.S. application Ser. No. 15/099,278 filed on Apr. 14, 2016, now issued as U.S. Pat. No. 9,671,195 on Jun. 6, 2017, which claims priority to Korean Application No. 10-2015-0052970, filed on Apr. 15, 2015, the entirety of each of which are incorporated by reference in their entirety.

BACKGROUND

The present disclosure relates to a dot sighting device, and more particularly, a dot sighting device capable of enabling a user to zero rapidly.

In the past, a dot sighting device configured such that an optical sighting device employs a no-power lens or a low-power lens and uses an aiming point with no complicated line of sight has been developed.

The dot sighting device with the no- or low-power lens helps the user rapidly aim at a target and is useful at a short distance or in an urgent situation.

Specifically, a time necessary to align a line of sight can be reduced, and since the user has only to match a dot reticle image with a real target, the user can be given a time enough to secure a field of vision. Thus, a target can be aimed rapidly and accurately, and a field of vision necessary to determine a surrounding situation can be secured.

The dot sighting device performs zeroing by moving a light source, but adjusting units for moving the light source are arranged on different surfaces of the dot sighting device (for example, the adjusting units are arranged in directions symmetrical to each other), and thus it is inconvenient to use.

A zeroing method of performing zeroing by operating the adjusting units arranged on the different surfaces causes a time delay in a situation in which rapid zeroing is required.

In addition, when the dot sighting device is designed, since the adjusting units for zeroing are arranged on the different surfaces, the volume of the dot sighting device is increased.

BRIEF SUMMARY

In an example, a sighting device includes a body, a light emitting unit, a bracket, a first adjusting unit and a second adjusting unit. The body couples to an arm having a barrel. The body is disposed relative to the arm in a first direction defined on an up and down axis. A third direction is defined as a direction of the barrel on a front and back axis. A second direction is defined as a left and right axis. The bracket couples to the light emitting unit. The first adjusting unit couples the bracket to the body and moves the bracket relative to the body in the third direction. The second adjusting unit couples the bracket to the body and moves the bracket relative to the body in the first direction.

In another example, a sighting device includes a body, a light emitting unit, a bracket, a first adjusting unit and a second adjusting unit. The body couples to an arm having a barrel. The body is disposed relative to the arm in a first direction defined on an up and down axis. A third direction is defined as a direction of the barrel on a front and back axis. A second direction is defined as a left and right axis. The bracket couples to the light emitting unit. The first adjusting unit couples the bracket to the body and moves the bracket relative to the body in the first direction. The second adjusting unit couples the bracket to the body and moves the bracket relative to the body in the third direction.

BRIEF DESCRIPTION OF THE DRAWINGS

For a better understanding of the aforementioned embodiments as well as additional embodiments thereof, reference should be made to the Detailed Description below, in conjunction with the following drawings in which like reference numerals refer to corresponding parts throughout the figures.

DETAILED DESCRIPTION

Hereinafter, preferred embodiments will be described in detail with reference to the drawings. Note that, in this specification and the drawings, elements that have substantially the same function and structure are denoted with the same reference signs, and repeated explanation is omitted.

First, a dot sighting device according to a first embodiment will be described with reference to FIGS. 1 to 9.

Figure 1:
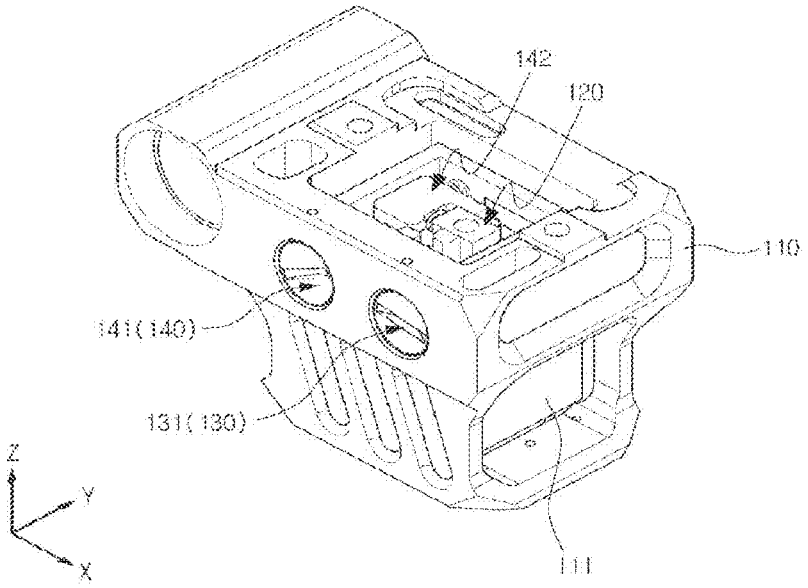
FIG. 1 is a perspective view illustrating a dot sighting device according to the first embodiment.
Figure 2:
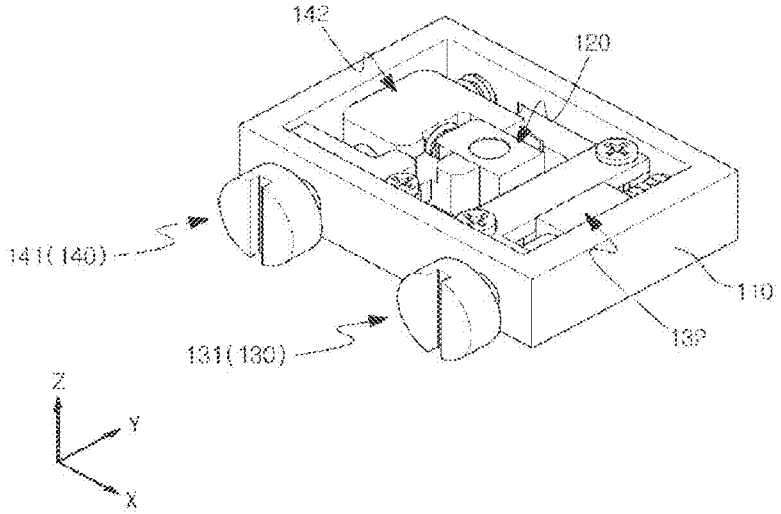
FIG. 2 is a perspective view illustrating a first aiming point moving unit and a second aiming point moving unit illustrated in FIG. 1.
Figure 3:
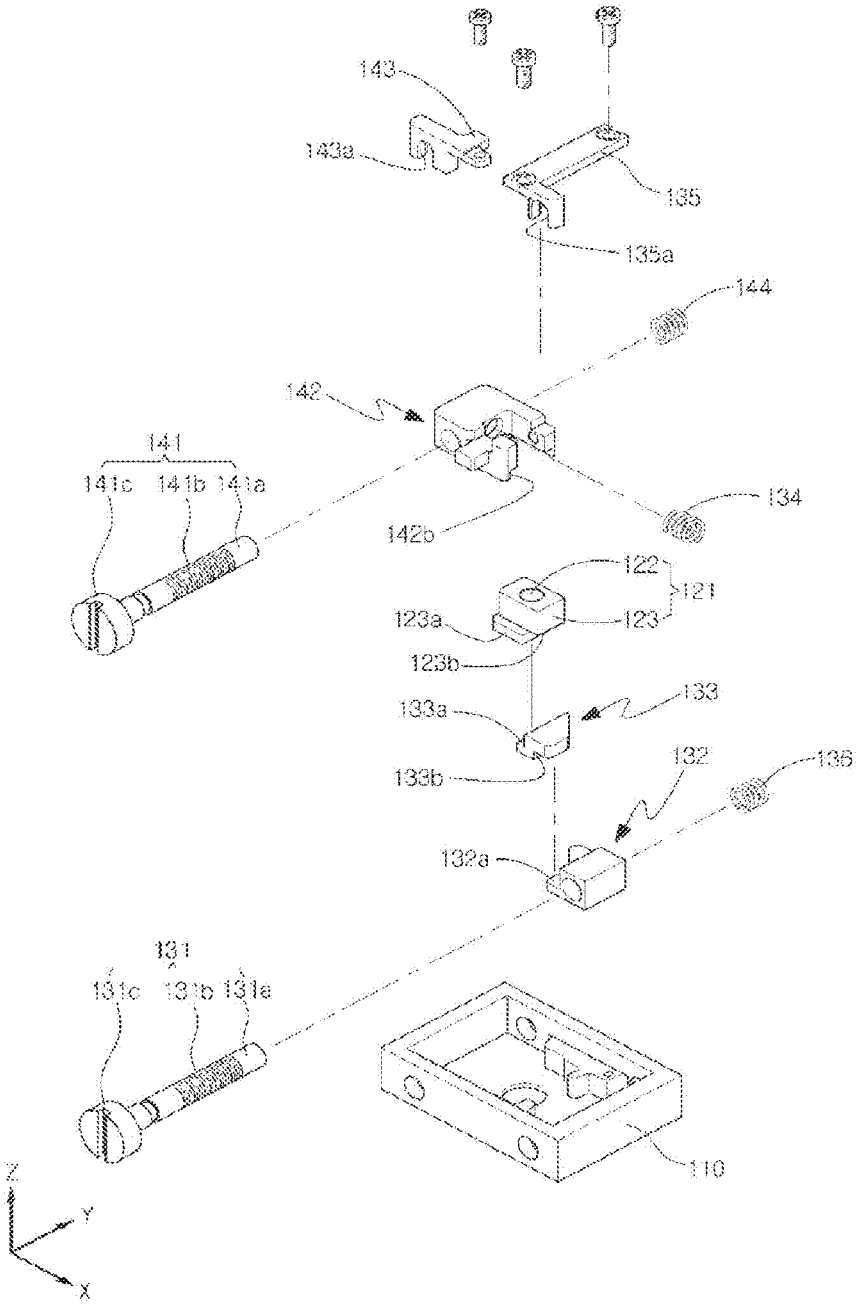
FIG. 3 is an exploded perspective view illustrating the first aiming point moving unit and the second aiming point moving unit according to the first embodiment.
Figure 4:
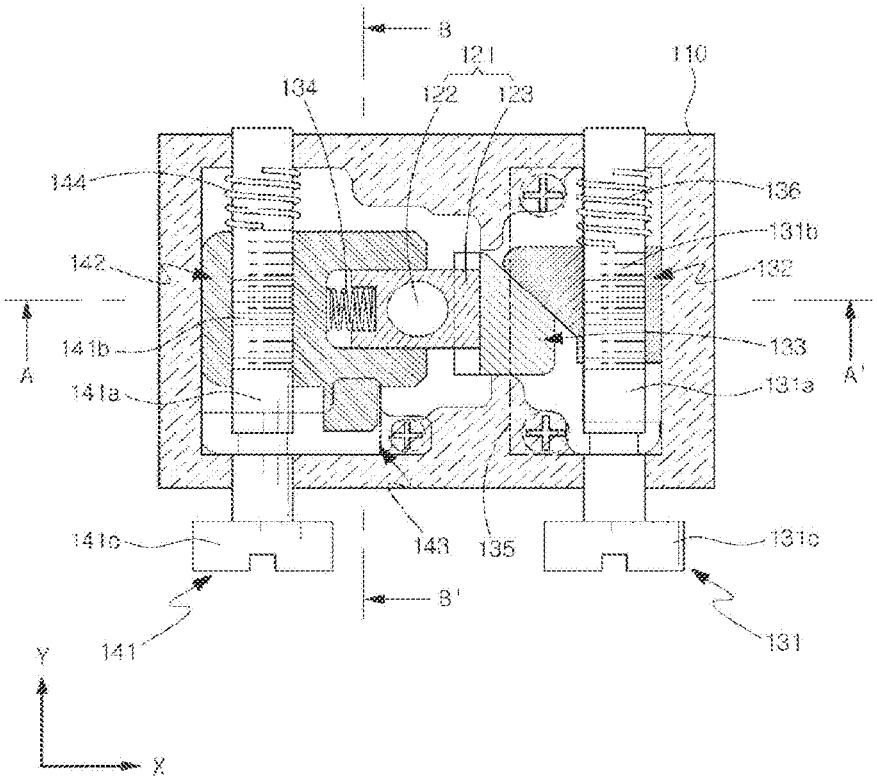
FIG. 4 is a partial cross-sectional plan view illustrating the first aiming point moving unit and the second aiming point moving unit.
Figure 5:
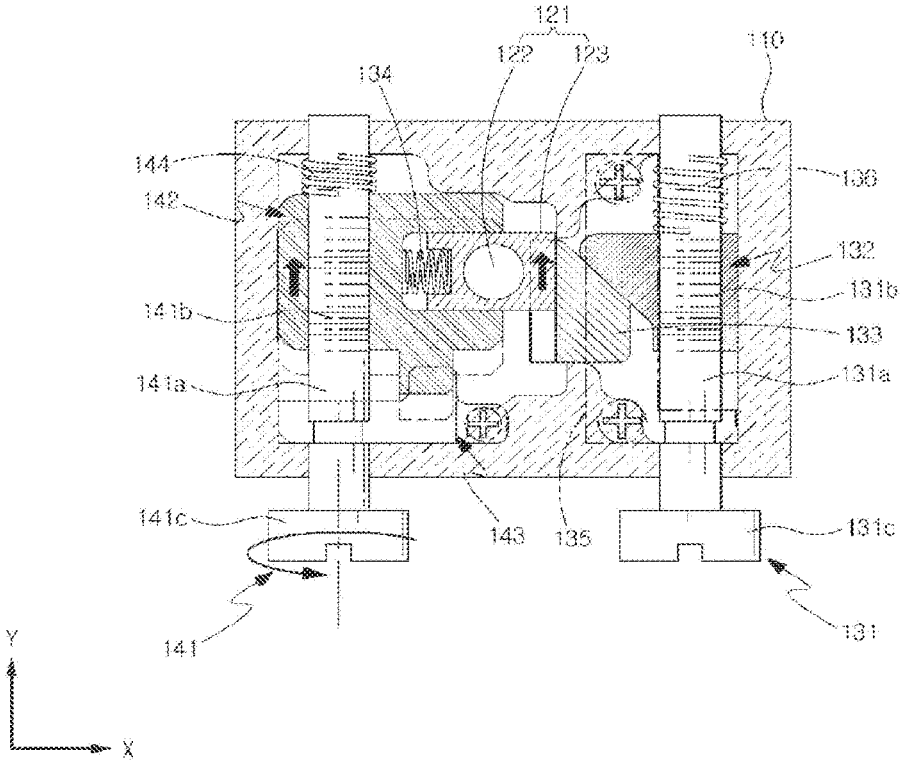
FIG. 5 is a partial cross-sectional plan view illustrating an operation of the second aiming point moving unit.
Figure 6:
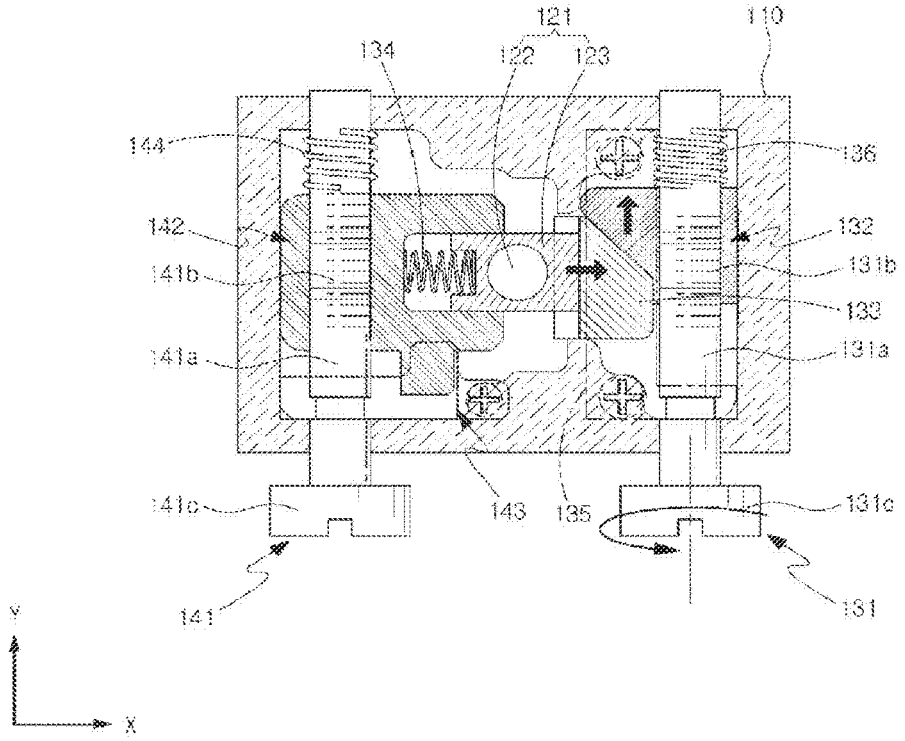
FIG. 6 is a partial cross-sectional plan view illustrating an operation of the first aiming point moving unit.
Figure 7A:
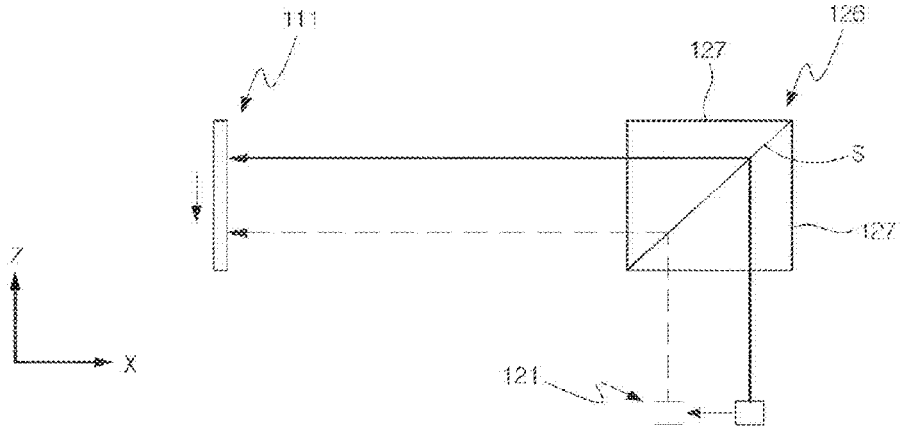
FIGS. 7A and 7B are plan views illustrating a zeroing operation for adjusting an aiming point through the first and second aiming point moving units according to the first embodiment.
Figure 7B:
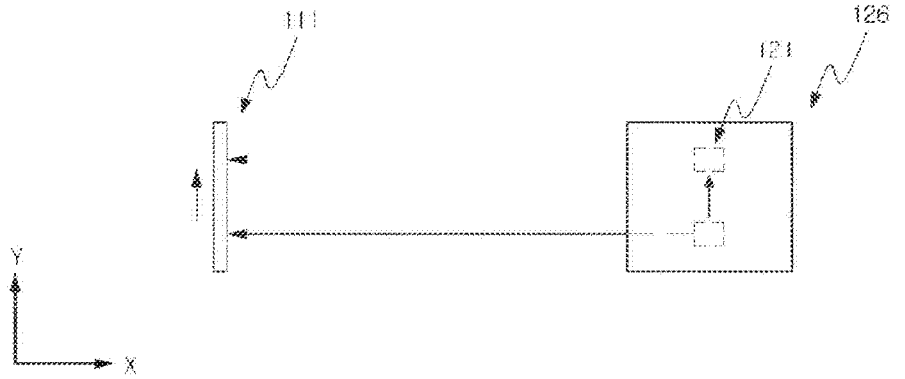
Figure 8:
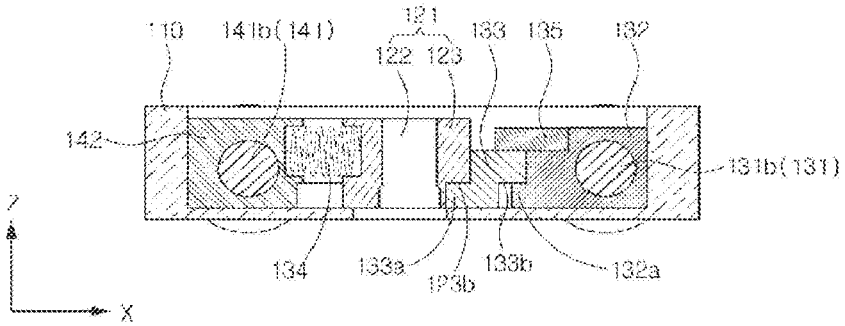
FIG. 8 is a cross-sectional view taken along line of A-A' of FIG. 4.
Figure 9:
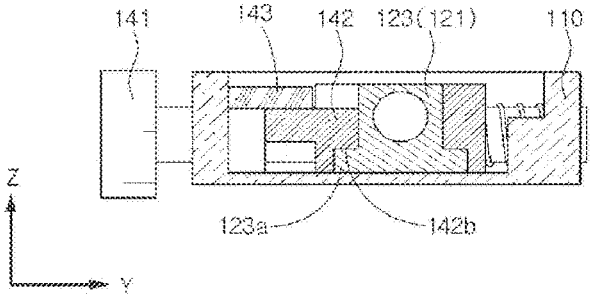
FIG. 9 is a cross-sectional view taken along line of B-B' of FIG. 4.

FIG. 1 is a perspective view illustrating a dot sighting device according to the first embodiment. FIG. 1 illustrates a state in which the dot sighting device is upside down. FIG. 2 is a view illustrating a first aiming point moving unit and a second aiming point moving unit illustrated in FIG. 1. FIG. 3 is an exploded perspective view illustrating the first aiming point moving unit and the second aiming point moving unit according to the first embodiment. FIG. 4 is a plan view illustrating the first aiming point moving unit and the second aiming point moving unit. FIG. 5 is a view illustrating an operation of the second aiming point moving unit. FIG. 6 is a view illustrating an operation of the first aiming point moving unit. FIGS. 7A and 7B are views illustrating a zeroing operation for adjusting an aiming point through the first and second aiming point moving units according to the first embodiment. FIG. 8 is a cross-sectional view taken along line of A-A' of FIG. 4, and FIG. 9 is a cross-sectional view taken along line of B-B' of FIG. 4.

In the drawings, a first axis refers to a Z axis, a second axis refers to a Y axis, and a third axis refers to a X axis.

As illustrated in FIGS. 1 to 7B, the dot sighting device according to the present embodiment includes a sight body 110, an aiming point generation unit 120, a first aiming point moving unit 130, and a second aiming point moving unit 140. The sight body 110 includes a window 111 through which a target is aimed at. The sight body 110 preferably has a rectangular parallelepiped shape. The aiming point generation unit 120 includes a light source 121 that is arranged inside the sight body 110 and emits an aiming point to be projected onto the window 111. The first aiming point moving unit 130 including a first adjusting unit 131 that is coupled with the light source 121 and moves the aiming point on the window 111 in a first axis direction by moving the light source 121. The second aiming point moving unit 140 includes a second adjusting unit 141 that is coupled with the light source 121 and moves the aiming point on the window 111 in a second axis direction orthogonal to the first axis direction by moving the light source 121. The second adjusting unit 141 and the first adjusting unit 131 are arranged the same surface.

The first aiming point moving unit 130 and the second aiming point moving unit 140 are used for zeroing of the dot sighting device of the present embodiment. For the sake of the user's convenient zeroing, the first adjusting unit 131 and the second adjusting unit 141 are arranged to be adjacent to each other, that is, in parallel.

The first adjusting unit 131 and the second adjusting unit 141 can be arranged together in any one of the first axis direction and the second axis direction from the center of the sight body 110, but, for the sake of convenience of description, the description will proceed with an example in which the first adjusting unit 131 and the second adjusting unit 141 are arranged together in the second axis direction from the center of the sight body 110.

The sight body 110 is removably coupled to a firearm, for example, a small arm such as a handgun, a pistol, or a rifle or a machine gun. The aiming point generation unit 120 is arranged inside the sight body 110, and the first adjusting unit 131 and the second adjusting unit 141 are exposed for zeroing.

In the present embodiment, the window 111 may be provided with a protection glass (not illustrated) for protecting a beam splitter 126 (which will be described later).

The aiming point generation unit 120 includes the light source 121 that emits light for forming the aiming point to be projected onto the window 111 and the beam splitter 126 that reflects at least part of the light emitted from the light source 121 toward the window 111.

As illustrated in FIG. 3, the light source 121 includes a light emitting unit 122 that emits light and a fixing bracket 123 for fixing the light emitting unit 122. The light emitting unit 122 is configured with a light emitting diode (LED), but the present invention is not limited thereto, and any other type of emitting element can be used as the light emitting unit 122.

The light source 121 is arranged in the first axis direction from the center of the sight body 110 to emit toward the beam splitter 126. In the present embodiment, the light source 121 is arranged below the center of the sight body 110 to emit the light toward the beam splitter 126 arranged above the light source 121.

The beam splitter 126 is arranged above the light source 121, and reflects the light emitted from the light source 121 toward the window 111. The beam splitter 126 may be configured with a beam splitting prism 127 in which two right-angled prisms are combined.

In other words, preferably, 50% reflective coating is applied to one of two inclined planes S forming the boundary between the two right-angled prisms, and then the two right-angled prisms bond with each other, so that the beam splitter 126 that passes 50% and reflects 50% is formed. The beam splitter 126 reflects at least part (for example, 50%) of the light emitted from the light source 121 toward the window 111. In other words, the light emitted from the light source 121 is reflected in the third axis direction by the inclined plane S of the beam splitter 126.

Light reflected by an external target passes through the beam splitter 126 and the window 111 and reaches the eyes of the user.

The first aiming point moving unit 130 functions to move the aiming point on the window 111 in the first axis direction. To this end, the first aiming point moving unit 130 includes the first adjusting unit 131 that moves the aiming point on the window 111 in the first axis direction by moving the light source 121.

The first adjusting unit 131 is rotatably supported to the sight body 110. In the present embodiment, as illustrated in FIG. 3, the first adjusting unit 131 includes a rotational shaft 131*a* that is rotatably coupled to the sight body 110, a thread portion 131*b* that is formed on the rotational shaft 131*a* and meshes with a first movement block 132 which will be described later, and a head portion 131*c* that is coupled to the rotational shaft 131*a* and used to rotate the rotational shaft 131*a*.

The first aiming point moving unit 130 further includes the first movement block 132 that meshes with the first adjusting unit 131 and moves in the second axis direction by the first adjusting unit 131 and a second movement block 133 that is coupled to the first movement block 132 and moves in the third axis direction orthogonal to the first axis direction and the second axis direction by the first movement block 132. The light source 121 is coupled to the second movement block 133.

The first movement block 132 meshes with the thread portion 131*b* and performs straight line movement in the second axis direction with the rotational movement of the first adjusting unit 131.

The first movement block 132 is movably coupled to an inner wall of the sight body 110 and performs straight line movement other than rotational movement when the first adjusting unit 131 performs rotational movement.

The second movement block 133 is arranged between the fixing bracket 123 and the first movement block 132 and coupled to the fixing bracket 123 and the first movement block 132. The second movement block 133 moves in the third axis direction with the movement of the first movement block 132 and moves the light source 121 coupled to the second movement block 133 in the third axis direction (see FIG. 6).

A contact surface between the first movement block 132 and the second movement block 133 is preferably inclined at an angle of 45° with respect to the second axis direction and the third axis direction so that the second movement block 133 moves in the third axis direction with the movement of the first movement block 132 in the second axis direction. When the angle of the contact surface between the first movement block 132 and the second movement block 133 is less than 45°, more accurate zeroing can be performed. In other words, the angle of the contact surface between the first movement block 132 and the second movement block 133 may be equal to or larger than 10° and equal to or less than 45°.

The first aiming point moving unit 130 further includes a pressurizing member 134 that is coupled to the second aiming point moving unit 140 and elastically pressurizes the light source 121 toward the second movement block 133.

In the present embodiment, the pressurizing member 134 is supported to the third movement block 142, and elastically pressurizes the fixing bracket 123 toward the second movement block 133. In the present embodiment, the pressurizing member 134 is configured with a spring that elastically biases the light source 121 toward the second movement block 133.

As the pressurizing member 134 elastically pressurizes the light source 121 toward the second movement block 133, the light source 121 can moves a positive or negative direction in the third axis direction.

The movement of the light source 121 in the third axis direction causes the aiming point on the window 111 in the first axis direction as illustrated in FIG. 7A.

The second aiming point moving unit 140 moves the aiming point on the window 111 in the second axis direction. To this end, the second aiming point moving unit 140 includes the second adjusting unit 141 that moves the light source 121 so that the aiming point on the window 111 moves in the second axis direction.

The second adjusting unit 141 is rotatably supported to the sight body 110. In the present embodiment, the second adjusting unit 141 includes a rotational shaft 141*a* that is rotatably coupled to the sight body 110, a thread portion 141*b* that is formed on the rotational shaft 141*a* and meshes with the third movement block 142 which will be described later, and a head portion 141*c* that is coupled to the rotational shaft 141*a* and used to rotate the rotational shaft 141*a*. By rotating or fastening or loosening the head portions 131*c* and 141*c* using a screw driver, a wrench, or the like, the first and second adjusting units 131 and 141 move in the second axis direction. In the present embodiment, each of the head portions 131*c* and 141*c* is preferably a slotted head and may be any other type of head such as a Phillips head, a square drive head, or the like. Each of the head portions 131*c* and 141*c* may be configured in a knob form.

The second aiming point moving unit 140 further includes the third movement block 142 that meshes with the second adjusting unit 141, moves in the second axis direction with the movement of the second adjusting unit 141, and supports the light source 121.

The third movement block 142 meshes with the thread portion 141*b* and performs straight line movement in the second axis direction with the rotational movement of the second adjusting unit 141. The third movement block 142 is movably coupled to the inner wall of the sight body 110, and performs straight line movement other than rotational movement with the rotational movement of the second adjusting unit 141.

With the movement of the third movement block 142 in the second axis direction, the light source 121 moves in the second axis direction (see FIG. 5).

The movement of the light source 121 in the second axis direction causes the aiming point on the window 111 to move in the second axis direction as illustrated in FIG. 7B.

The first aiming point moving unit 130 further includes a first support member 135 that is arranged above the first movement block 132 to limit the movement of the first movement block 132 in the first axis direction according to the rotation of the first adjusting unit 131 and a pressurizing member 136 that is arranged between the first movement block 132 and the sight body 110 and elastically pressurizes the first movement block 132 along the second axis.

The first support member 135 is fixed at a predetermined distance from one side (a right side in FIG. 4) the sight body 110 so that the first movement block 132 is interposed between the sight body 110 and the first support member 135 as illustrated in FIG. 8. The first movement block 132 arranged between the first support member 135 and the sight body 110 is guided to move in the second axis direction but limited not to move in the first axis direction intersecting with a plane defined by the second axis and the third axis. Thus, the first movement block 132 performs straight line movement with the rotation of the first adjusting unit 131, and at this time, the movement of the first movement block 132 in the first axis direction is prevented. A first fixing piece 135*a* is coupled to the first support member 135 to support the first adjusting unit 131 so that the first adjusting unit 131 is rotatable. The first fixing piece 135*a* is preferably integrally with the first support member 135.

The first support member 135 is arranged above the first movement block 132 and the second movement block 133 to limit the movement of the first movement block 132 in the first axis direction and the movement of the second movement block 133 in the first axis direction at the same time.

The pressurizing member 136 may be configured with a coil-like spring into which the rotational shaft 131*a* is inserted. Since the first movement block 132 meshes with the thread portion 131*b*, that is, since the male thread 131*b* meshes with the female thread formed on the inner wall of the first movement block 132, there may be a slight assembly error in the second axis direction, and the assembly error reduces the aiming accuracy. However, since the first movement block 132 is elastically supported in one direction on the second axis by the pressurizing member 136, the movement is performed in the state in which the male thread 131*b* comes into close contact with the female thread, and thus the reduction in the aiming accuracy by the assembly error can be prevented.

For the sake of convenience of assembly, preferably, the first fixing piece 135*a* is arranged at a side of one end of the rotational shaft 131*a*, and the pressurizing member 136 is arranged at a side of the other end of the rotational shaft 131*a* that is exposed from the first movement block 132.

The second aiming point moving unit 140 further includes a second support member 143 that is arranged above the third movement block 142 and fixed to the sight body 110 to limit the movement of the third movement block 142 in the first axis direction with the rotation of the second adjusting unit 141 and a pressurizing member 144 that is arranged between the third movement block 142 and the sight body 110 and elastically pressurizes the third movement block 142 in one direction on the second axis.

The second support member 143 is fixed at a predetermined distance from one side (a left side in FIG. 4) of the sight body 110 so that the third movement block 142 is interposed between the second support member 143 and the sight body 110. The third movement block 142 arranged between the second support member 143 and the sight body 110 is guided to move in the second axis direction and limited not to move in the first axis direction intersecting with the plane defined by the second axis and the third axis. Thus, the third movement block 142 performs straight line movement in the second axis direction with the rotation of the second adjusting unit 141, and at this time, the movement of the third movement block 142 in the first axis direction is prevented. A second fixing piece 143*a* is coupled to the second support member 143 to support the second adjusting unit 141 so that the second adjusting unit 141 is rotatable. The second fixing piece 143*a* is preferably integrally with the second fixing piece 143*a*.

The pressurizing member 144 may be configured with a coil-like spring into which the rotational shaft 141*a* is inserted and used to prevent the reduction in the aiming accuracy by the assembly error of the third movement block 142 and the second adjusting unit 141, similarly to the pressurizing member 136.

For the sake of convenience of assembly, preferably, the second fixing piece 143*a* is arranged at a side of one end of the rotational shaft 141*a*, and the pressurizing member 144 is arranged at a side of the other end of the rotational shaft 141*a* that is exposed from the third movement block 142.

The first movement block 132 and the second movement block 133, the second movement block 133 and the fixing bracket 123, and the fixing bracket 123 and the third movement block 142 come into contact with each other in the first axis direction and are engaged with each other such that the movement thereof in the first axis direction is limited.

Specifically, as illustrated in FIGS. 8 and 9, the first movement block 132 includes an engagement protrusion 132*a*, and the second movement block 133 includes an engagement recess 133*b*. The first movement block 132 is engaged with the second movement block 133 such that the engagement protrusion 132*a* is inserted into the engagement recess 133*b*. The second movement block 133 further includes an engagement protrusion 133*a*, and the fixing bracket 123 includes an engagement recess 123*b*. The second movement block 133 is engaged with the fixing bracket 123 such that the engagement protrusion 133*a* is inserted into the engagement recess 123*b*. The fixing bracket 123 further includes an engagement protrusion 123*a*, and the third movement block 142 includes an engagement recess 142*b*. The fixing bracket 123 is engaged with the third movement block 142 such that the engagement protrusion 123*a* is inserted into the engagement recess 142*b*. Thus, the first movement block 132 and the second movement block 133 that are engaged with each other in the first axis direction and the fixing bracket 123 and the third movement block 142 that are engaged with in the first axis direction are interposed between the first support member 135 and the second support member 143 and the sight body 110, the movement of the first movement block 132, the second movement block 133, the fixing bracket 123, and the third movement block 142 in the first axis direction can be effectively limited.

Next, a zeroing operation of the dot sighting device according to the present embodiment will be described with reference to FIGS. 1 to 7.

When the second adjusting unit 141 is rotated in order to move the aiming point on the window 111 in the second axis direction (any one of the positive and negative directions) for zeroing, the third movement block 142 moves in the second axis direction with the rotation of the second adjusting unit 141 as illustrated in FIG. 5.

The movement of the third movement block 142 causes the light source 121 supported to the third movement block 142 to move in the second axis direction. As the light source 121 moves in the second axis direction, the aiming point on the window 111 moves in the second axis direction as illustrated in FIG. 7B.

In addition, when the first adjusting unit 131 is rotated (for example, in the state of FIG. 5) in order to move the aiming point on the window 111 in the first axis direction for zeroing, the first movement block 132 moves in the second axis direction with the rotation of the second adjusting unit 141 as illustrated in FIG. 6.

The movement of the first movement block 132 in the second axis direction causes the second movement block 133 to move in the third axis direction, and thus the light source 121 moves in the third axis direction with the movement of the second movement block 133.

As the light source 121 moves in the third axis direction, the aiming point on the window 111 to moves in the first axis direction as illustrated in FIG. 7A.

As described above, in the dot sighting device according to the present embodiment, the first adjusting unit 131 and the second adjusting unit 141 that move the light source 121 emitting the aiming point to be projected onto the window 111 in the first axis direction and the second axis direction are arranged on the same plane or surface to be adjacent to each other, that is, in parallel, and thus the user can move the aiming point in the first axis direction and the second axis direction for zeroing rapidly and conveniently.

Figure 10:
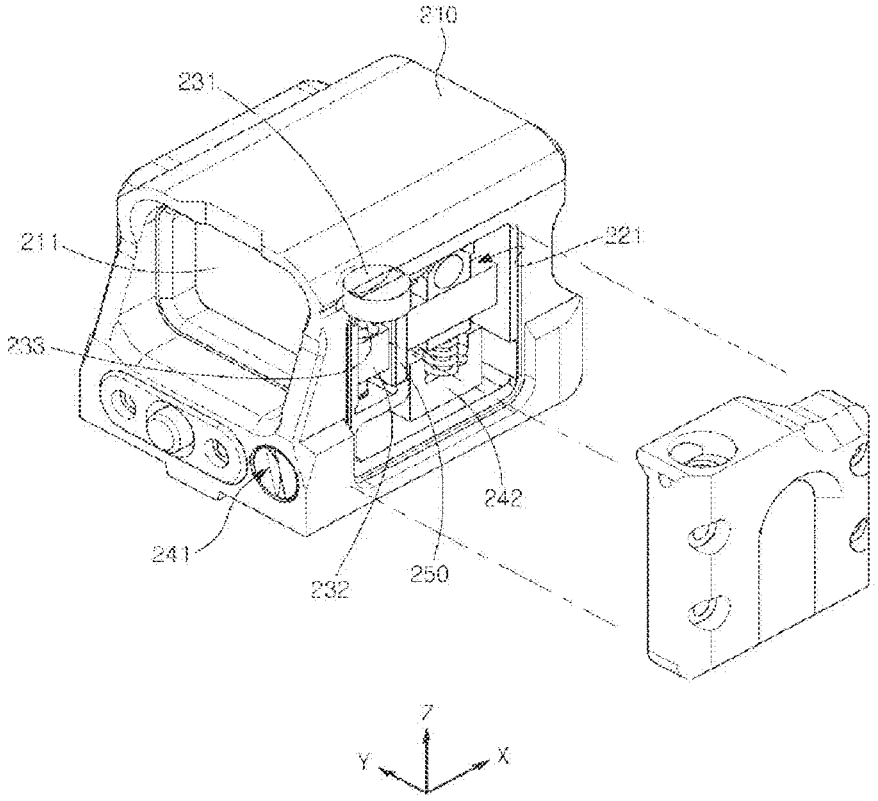
FIG. 10 is a perspective view illustrating a dot sighting device according to a second embodiment of the present disclosure.
Figure 11:
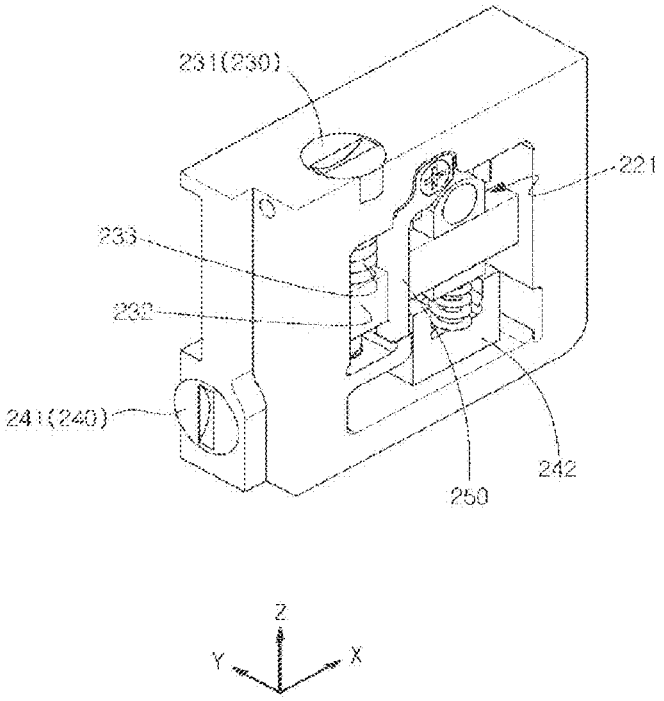
FIG. 11 is a perspective view illustrating a first aiming point moving unit and a second aiming point moving unit according to the second embodiment.
Figure 12:
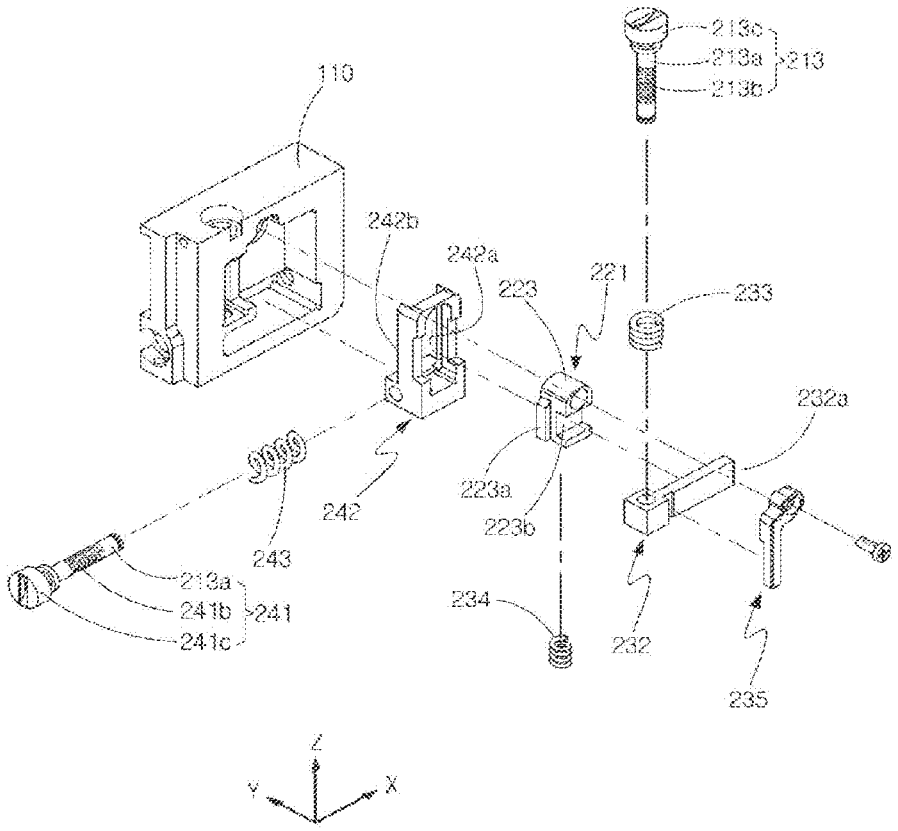
FIG. 12 is an exploded perspective view illustrating the first aiming point moving unit and the second aiming point moving unit according to the second embodiment.
Figure 13:
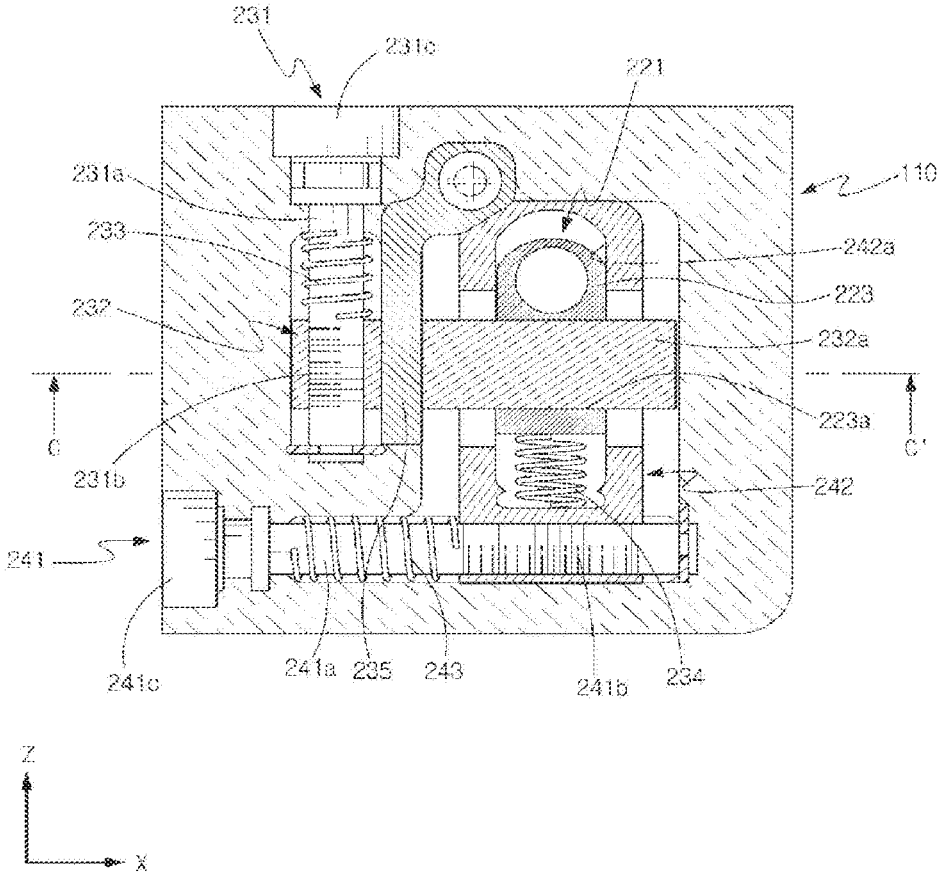
FIG. 13 is a partial cross-sectional plan view illustrating the first aiming point moving unit and the second aiming point moving unit according to the second embodiment.
Figure 14:
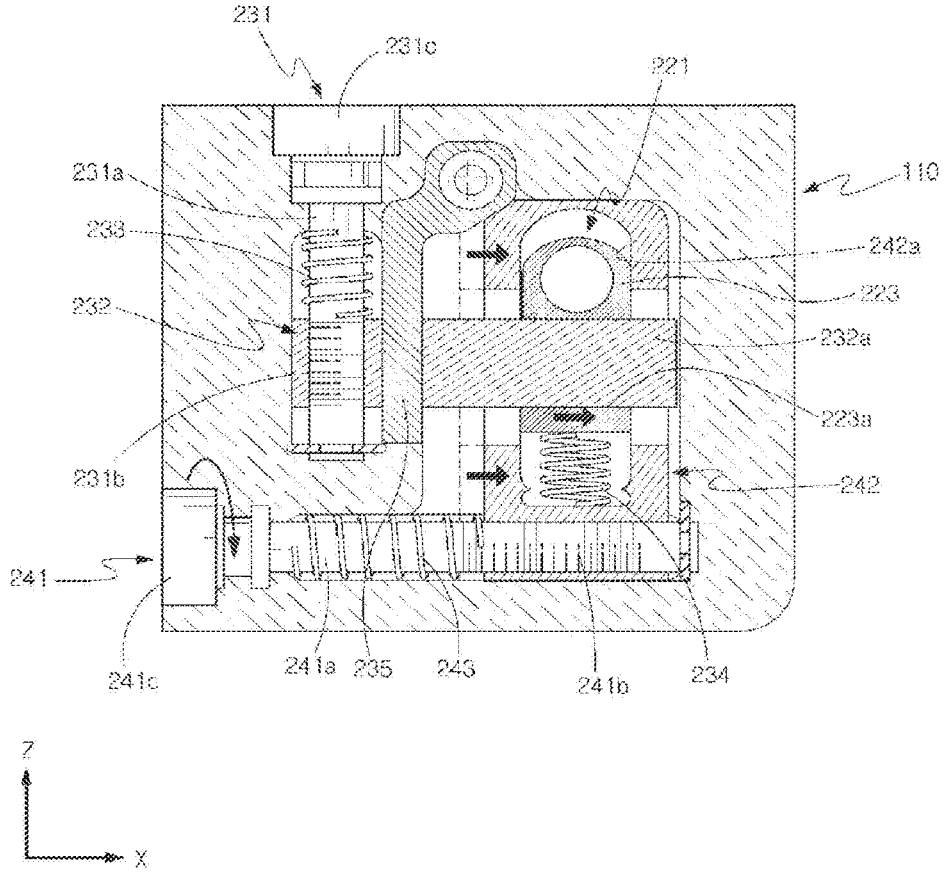
FIG. 14 is a partial cross-sectional plan view illustrating an operation of the second aiming point moving unit.
Figure 15:
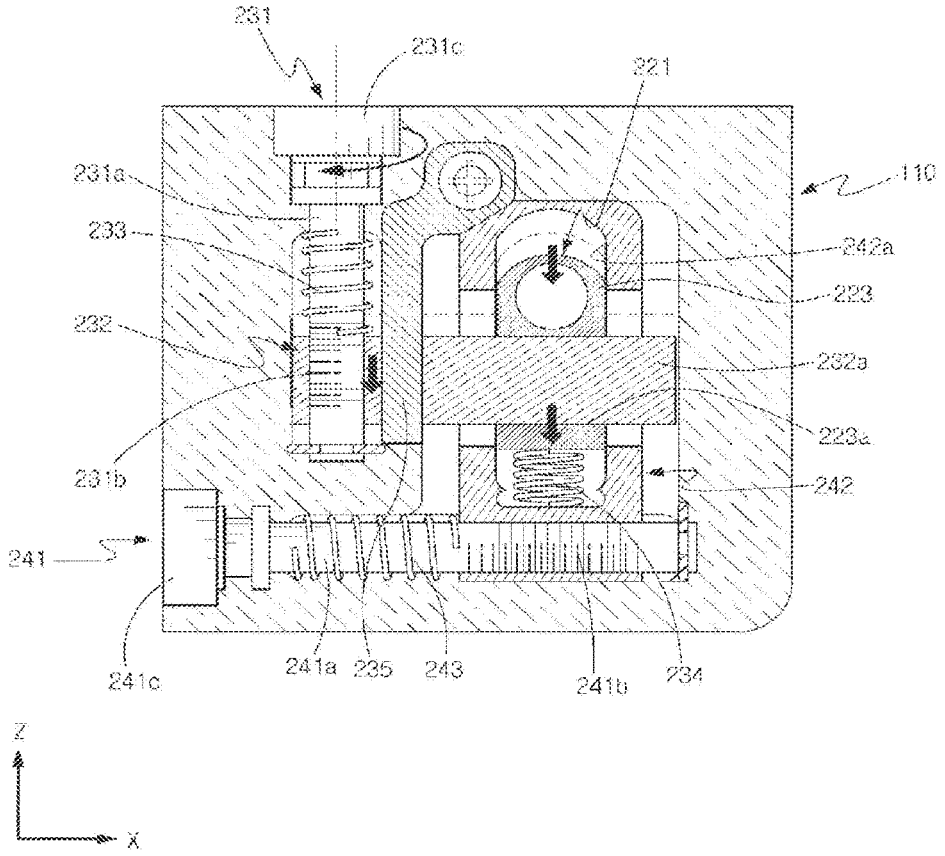
FIG. 15 is a partial cross-sectional plan view illustrating an operation of the first aiming point moving unit.
Figure 16A:
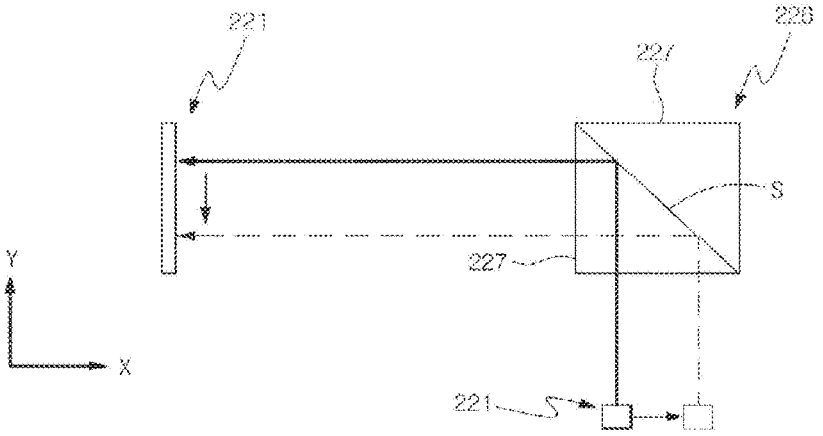
FIGS. 16A and 16B are views illustrating a zeroing operation for adjusting an aiming point through the first and second aiming point moving units according to the second embodiment.
Figure 16B:
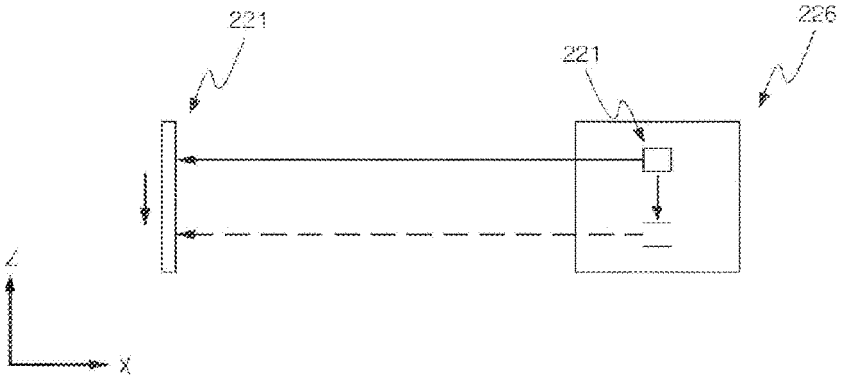
Figure 17:
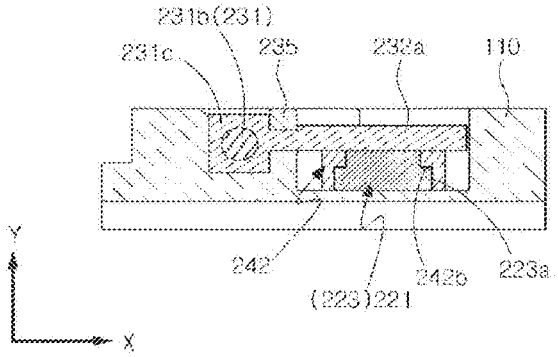
FIG. 17 is a cross-sectional view taken along line of C-C' of FIG. 13.

FIG. 10 is a perspective view illustrating a dot sighting device according to a second embodiment of the present invention. FIG. 11 is a view illustrating a first aiming point moving unit and a second aiming point moving unit according to the second embodiment. FIG. 12 is an exploded perspective view illustrating the first aiming point moving unit and the second aiming point moving unit according to the second embodiment. FIG. 13 is a plane view illustrating the first aiming point moving unit and the second aiming point moving unit according to the second embodiment. FIG. 14 is a view illustrating an operation of the second aiming point moving unit. FIG. 15 is a view illustrating an operation of the first aiming point moving unit. FIGS. 16A and 16B are views illustrating a zeroing operation for adjusting an aiming point through the first and second aiming point moving units according to the second embodiment. FIG. 17 is a cross-sectional view taken along line of C-C' of FIG. 13.

The description will proceed with different points with the first embodiment.

In the present embodiment, a light source 221 is arranged on the side of the sight body 210, that is, on the right side in FIG. 10, and emits light toward a beam splitter 226.

The beam splitter 226 reflects the light emitted from the light source 221 toward a window 211. The beam splitter 226 has the same configuration as that of the first embodiment. Specifically, in the present embodiment, the beam splitter 226 is configured with a beam splitting prism 227 in which two right-angled prisms are combined, similarly to the first embodiment. The beam splitter 226 has an inclined plane S that reflects the light emitted from the light source 221 in the third axis direction to which the gun barrel is parallel, similarly to the first embodiment.

In the present embodiment, the light source 221 includes a light emitting unit 222 that emits light and a fixing bracket 223 for fixing the light emitting unit 222.

In the present embodiment, a first aiming point moving unit 230 moves the aiming point on the window 211 in the first axis direction. To this end, the first aiming point moving unit 230 includes a first adjusting unit 231 that is rotatably supported to the sight body 210 and a fourth movement block 232 that meshes the first adjusting unit 231, supports the light source 221, and moves in the first axis direction by the movement of the first adjusting unit 231.

The first adjusting unit 231 includes a rotational shaft 231*a* that is rotatably coupled to the sight body 210, a thread portion 231*b* that is formed on the rotational shaft 231*a* and meshes with the fourth movement block 232 which will be described later, and a head portion 231*c* that is coupled to the rotational shaft 231*a* and used to rotate the rotational shaft 231*a*.

The fourth movement block 232 meshes with the thread portion 231*b* and moves in the first axis direction with the rotation of the head portion 231*c*. Since the fourth movement block 232 supports the light source 221, the light source 221 moves in the first axis direction with the movement of the fourth movement block 232 in the first axis direction (see FIG. 13).

As the light source 221 moves in the first axis direction, the aiming point on the window 211 moves in the first axis direction as illustrated in FIG. 16B.

The light source 221 is supported to the fourth movement block 232 to be rotatable in the third axis direction. To this end, the fourth movement block 232 includes a guide bar 232*a* that is inserted into a guide recess 223*b* of the fixing bracket 223.

The guide bar 232*a* of the fourth movement block 232 is inserted into the guide recess 223*b*, synchronizes the movement of the fourth movement block 232 in the first axis direction with the movement of the light source 221, and guides the movement of the light source 221 in the third axis direction.

In the present embodiment, a second aiming point moving unit 240 moves the aiming point on the window 211 in the second axis direction. To this end, the second aiming point moving unit 240 includes a second adjusting unit 241 that is rotatably supported to the sight body 210 and a fifth movement block 242 that meshes with the second adjusting unit 241, moves in the third axis direction with the movement of the second adjusting unit 241, and moves the light source 221 in the third axis direction. The light source 221 is coupled to the fifth movement block 242 to be movable in the first axis direction.

The second adjusting unit 241 is rotatably supported to the sight body 210 and rotates to move the light source 221 in the third axis direction. The second adjusting unit 241 includes a rotational shaft 241*a* that is rotatably coupled to the sight body 210, a thread portion 241*b* that is formed on the rotational shaft 241*a* and meshes with the fifth movement block 242 which will be described later, and a head portion 241*c* that is coupled to the rotational shaft 241*a* and used to rotate the rotational shaft 241*a*. In the present embodiment, each of the head portions 231*c* and 241*c* is preferably a slotted head and may be any other type of head such as a Phillips head, a square drive head, or the like. Each of the head portions 231*c* and 241*c* may be configured in a knob form.

The fifth movement block 242 meshes with the thread portion 241*b* and moves in the third axis direction with the rotation of the head portion 241*c* (see FIG. 14).

The fifth movement block 242 is coupled to the light source 221 and moves in the third axis direction to move the light source 221 in the third axis direction. As the light source 221 moves in the third axis direction, the aiming point on the window 211 moves in the second axis direction as illustrated in FIG. 16A.

The light source 221 is coupled to the fifth movement block 242 so that the light source 221 is movable in the first axis direction. To this end, the fifth movement block 242 includes a guide hole 242*a* that guides the movement of the light source 221 in the first axis direction. Preferably, the guide hole 242*a* has a long rectangular hole, and guides the movement of the light source 221 as the light source 221 is moved in the first axis direction by the first aiming point moving unit 230. However, the shape of the guide hole 242*a* is not limited thereto.

Thus, the movement of the light source 221 is confined to the movement of the fifth movement block 242 in the third axis direction. As the fifth movement block 242 moves in the third axis direction, the light source 221 moves in the third axis direction together with the fifth movement block 242, and as the fourth movement block 232 moves in the first axis direction, the light source 221 moves along the guide hole 242*a* of the fifth movement block 242 in the first axis direction.

The first aiming point moving unit 230 further includes a pressurizing member 233 that elastically pressurizes the fourth movement block 232 in one direction on the first axis. The rotational shaft 231*a* is inserted into the pressurizing member 233, and thus the pressurizing member 233 is arranged between the fourth movement block 232 and the head portion 231*c*.

The pressurizing member 233 may be configured with a coil-like spring. Since the fourth movement block 232 meshes with the thread portion 231*b*, that is, since the male thread 231*b* meshes with the female thread formed on the inner wall of the fourth movement block 232, there may be a slight assembly error in the first axis direction, and the assembly error reduces the aiming accuracy. However, since the fourth movement block 232 is elastically supported in one direction on the first axis by the pressurizing member 233, the movement is performed in the state in which the male thread 231*b* comes into close contact with the female thread, and thus the reduction in the aiming accuracy by the assembly error can be prevented.

The first aiming point moving unit 230 may further include a pressurizing member 234 that is coupled to the second aiming point moving unit 240 and elastically pressurizes the light source 221 toward the fourth movement block 232. Elastic force of the pressurizing member 234 is set to be relatively larger or smaller than that of the pressurizing member 233, and the pressurizing member 234 preferably causes the fourth movement block 232 to be elastically supported in one direction in a shaft direction of the first adjusting unit 231.

In the present embodiment, the pressurizing member 234 is supported to the fifth movement block 242 and elastically the fixing bracket 223 toward the fourth movement block 232. In the present embodiment, the pressurizing member 234 is configured with a spring that elastically biases the light source 221 toward the fourth movement block 232. As the pressurizing member 234 elastically pressurizes the light source 221 toward the fourth movement block 232, the light source 221 can move in the positive or negative direction in the first axis direction.

The first aiming point moving unit 230 further includes a third support member 235 that is arranged above the fourth movement block 232 and coupled to the sight body 110. The third support member 235 limits the movement of the fourth movement block 232 in the second axis direction with the rotation of the first adjusting unit 231.

Particularly, as illustrated in FIG. 17, in the state in which the fourth movement block 232 and the fifth movement block 242 are interposed between the sight body 110 and the third support member 235, the fourth movement block 232 and the fifth movement block 242 are guided to move in the first axis and the third axis but limited not to move in the second axis direction intersecting with the plane defined by the first axis and the third axis.

The fifth movement block 242 and the fixing bracket 223 come into contact with each other in the second axis direction and are engaged with each other such that the movement thereof in the second axis direction is limited.

Specifically, as illustrated in FIG. 17, the fixing bracket 223 includes an engagement protrusion 223*a*, and the fifth movement block 242 includes an engagement recess 242*b*. The fixing bracket 223 is engaged with the fifth movement block 242 such that the engagement protrusion 223*a* is inserted into the engagement recess 242*b*, and thus the movement of the fixing bracket 223 in the second axis direction is limited. At this time, the movement of the fifth movement block 242 in the second axis direction is limited by the guide bar 232 of the fourth movement block 232, and the movement of the fourth movement block 232 in the second axis direction is limited by the third support member 235. In other words, the fixing bracket 223, the fifth movement block 242, and the fourth movement block 232 are sequentially stacked on the sight body 110, and the movement of the fourth movement block 232 in the second axis direction is limited by the third support member 235. Thus, the movement of the fixing bracket 223, the fifth movement block 242, and the fourth movement block 232 in the second axis direction can be effectively limited.

The second aiming point moving unit 240 further include a pressurizing member 243 that elastically pressurizes the fifth movement block 242 in one direction on the third axis. The rotational shaft 241*a* is inserted into the pressurizing member 233, and thus the pressurizing member 233 is arranged between the fifth movement block 242 and the head portion 241*c*.

The pressurizing member 243 may be configured with a coil-like spring. Similarly to the pressurizing member 233, the pressurizing member 243 prevents the reduction in the aiming accuracy by the assembly error of the fifth movement block 242 and the second adjusting unit 241.

Next, a zeroing operation of the dot sighting device according to the present embodiment will be described with reference to FIGS. 10 to 16.

When the second adjusting unit 241 is rotated in order to move the aiming point on the window 211 in the second axis direction (any one of the positive and negative directions) for zeroing, the fifth movement block 242 moves in the third axis direction with the rotation of the second adjusting unit 241 as illustrated in FIG. 14.

The movement of the fifth movement block 242 causes the light source 221 supported to the fifth movement block 242 to move in the third axis direction. As the light source 221 moves in the third axis direction, the aiming point on the window 211 moves in the second axis direction as illustrated in FIG. 16B.

In addition, when the first adjusting unit 231 is rotated (for example, in the state of FIG. 14) in order to move the aiming point on the window 211 in the first axis direction for zeroing, the fourth movement block 232 moves in the first axis direction with the rotation of the first adjusting unit 231 as illustrated in FIG. 15.

The movement of the fourth movement block 232 in the first axis direction causes the fourth movement block 232 to move in the first axis direction, and the light source 221 moves in the first axis direction with the movement of the fourth movement block 232.

As the light source 221 moves in the first axis direction, the aiming point on the window 211 moves in the first axis direction as illustrated in FIG. 16B.

As described above, in the dot sighting device according to the present embodiment, the first adjusting unit 231 and the second adjusting unit 241 that move the light source 221 emitting the aiming point to be projected onto the window 211 in the first axis direction and the second axis direction are arranged on the same plane or surface to be adjacent to each other, that is, perpendicular to each other, and thus the user can move the aiming point in the first axis direction and the second axis direction for zeroing rapidly and conveniently.

In light of the foregoing, an exemplary object of the present disclosure to provide a dot sighting device capable of enabling the user to zero rapidly.

It will be apparent to those skilled in the art that various changes and modifications may be made without departing from the spirit and scope of the embodiments as defined in the following claims. While various embodiments in accordance with the disclosed principles have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

While any discussion of or citation to related art in this disclosure may or may not include some prior art references, applicant neither concedes nor acquiesces to the position that any given reference is prior art or analogous prior art.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, the claims should not be limited by the language chosen under a heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A sighting device, comprising:

a body configured to couple to an arm having a barrel;

a light emitting unit;

a first adjusting unit configured to move the light emitting unit relative to the body to move an aiming point of the light emitting unit in a first direction; and a second adjusting unit configured to move the light emitting unit relative to the body to move the aiming point of the light emitting unit in a second direction different than the first direction, wherein the first adjusting unit is arranged on a first surface and the second adjusting unit is arranged on the first surface.

2. The sighting device of claim 1, wherein the first direction is orthogonal to the second direction.

3. The sighting device of claim 1, wherein the first direction is a left to right direction when the body is coupled to the arm.

4. The sighting device of claim 3, wherein the second direction is an up to down direction when the body is coupled to the arm.

5. The sighting device of claim 1, wherein the first adjusting unit is configured to move the light emitting unit in an up and down direction relative to the body when the body is coupled to the arm.

6. The sighting device of claim 5, wherein the second adjusting unit is configured to move the light emitting unit in a front and back direction relative to the body when the body is coupled to the arm.

7. The sighting device of claim 1, wherein the second adjusting unit is configured to move the light emitting unit in a front and back direction relative to the body when the body is coupled to the arm.

8. The sighting device of claim 7, wherein the first adjusting unit is configured to move the light emitting unit in a left and right direction relative to the body when the body is coupled to the arm.

9. The sighting device of claim 1, further comprising a bracket configured to couple to the light emitting unit.

10. The sighting device of claim 9, wherein the first adjusting unit and the second adjusting unit are respectively coupled to the bracket to respectively move the bracket to move the light emitting unit.

11. The sighting device of claim 1, further comprising a reflector configured to reflect light emitted by the light emitting unit; and a beam splitter configured to reflect at least some of the light emitted by the light emitting unit towards the reflector.

12. The sighting device of claim 11, wherein the light emitting unit is configured to emit light along the first direction.

13. The sighting device of claim 1, wherein the first adjusting unit includes a first head portion, the second adjusting unit includes a second head portion, and the first head portion and the second head portion are disposed at different sides of the body.

14. The sighting device of claim 13, wherein one of the first head portion and the second head portion is disposed at a side of the body in the first direction, and an other of the first head portion and the second head portion is disposed at a side of the body in the second direction.

15. The sighting device of claim 1, wherein the first adjusting unit includes a first movement block coupled to the body via a first threaded member.

16. The sighting device of claim 15, wherein the first threaded member is configured to engage the first movement block such that rotation of the first threaded member causes the first movement block to move in the first direction thereby causing the light emitting unit to move in the first direction.

17. The sighting device of claim 15, wherein the second adjusting unit includes a second movement block coupled to the body via a second threaded member.

18. The sighting device of claim 17, wherein the second threaded member is configured to engage the second movement block such that rotation of the second threaded member causes the second movement block to move in a barrel direction thereby causing the light emitting unit to move in the barrel direction.

19. The sighting device of claim 17, further comprising a pressurizing member is disposed between the light emitting unit and the first movement block.

* * * * *